US012540539B2

(12) United States Patent
Ungchusri et al.

(10) Patent No.: US 12,540,539 B2
(45) Date of Patent: Feb. 3, 2026

(54) WELL FRACTURE SYSTEMS AND METHODS

(71) Applicant: FMC Technologies, Inc., Houston, TX (US)

(72) Inventors: Tep Ungchusri, Houston, TX (US); Philippe Espinasse, Houston, TX (US); Jean-Luc Streiff, Houston, TX (US); Gary Bernard, Houston, TX (US); Brian Swagerty, Houston, TX (US); Johann Rongau, Houston, TX (US); Sunil Dutt, Houston, TX (US); Dan Fink, Houston, TX (US); Justin Taylor, Houston, TX (US); James Cook, Houston, TX (US)

(73) Assignee: FMC Technologies, Inc.

( * ) Notice: Subject to any disclaimer, the term of this patent is extended or adjusted under 35 U.S.C. 154(b) by 0 days.

(21) Appl. No.: 18/942,062

(22) Filed: Nov. 8, 2024

(65) Prior Publication Data

US 2025/0067156 A1 Feb. 27, 2025

Related U.S. Application Data

(63) Continuation of application No. 18/321,504, filed on May 22, 2023, now abandoned, which is a continuation of application No. 17/812,094, filed on Jul. 12, 2022, now abandoned, which is a continuation of application No. 17/046,568, filed as application No. PCT/US2019/026964 on Apr. 11, 2019, now abandoned.

(60) Provisional application No. 62/656,243, filed on Apr. 11, 2018.

(51) Int. Cl.
*E21B 43/26* (2006.01)
*E21B 17/20* (2006.01)

(52) U.S. Cl.
CPC ..... *E21B 43/2607* (2020.05); *E21B 17/20* (2013.01); *E21B 43/26* (2013.01)

(58) Field of Classification Search
CPC ..... E21B 43/2607; E21B 17/20; E21B 43/26
See application file for complete search history.

(56) References Cited

U.S. PATENT DOCUMENTS

| | | | | |
|---|---|---|---|---|
| 2018/0347286 | A1* | 12/2018 | Scott | E21B 17/05 |
| 2020/0277845 | A1* | 9/2020 | Kajaria | E21B 43/26 |
| 2021/0198953 | A1* | 7/2021 | Robinson | E21B 17/02 |
| 2024/0125415 | A1* | 4/2024 | Cook | F16L 33/28 |

* cited by examiner

*Primary Examiner* — James G Sayre
(74) *Attorney, Agent, or Firm* — Osha Bergman Watanabe & Burton LLP

(57) ABSTRACT

A method for performing simultaneous operations at a wellsite comprising two or more adjacent wellheads, each respectively connected to a well, may include the following steps: providing a fluid supply via upstream equipment to an intermediate supply point; fluidly connecting the intermediate supply point to a single wellhead, the fluidly connecting comprising connecting a first end of a flexible pipe to the intermediate supply point and a second end of the flexible pipe to a first wellhead; performing a wellbore operation on a first well using the fluid supply from the upstream equipment supplied to the first wellhead; disconnecting the second end of the flexible pipe from the first wellhead; and connecting the second end of the flexible pipe to a second wellhead.

21 Claims, 8 Drawing Sheets

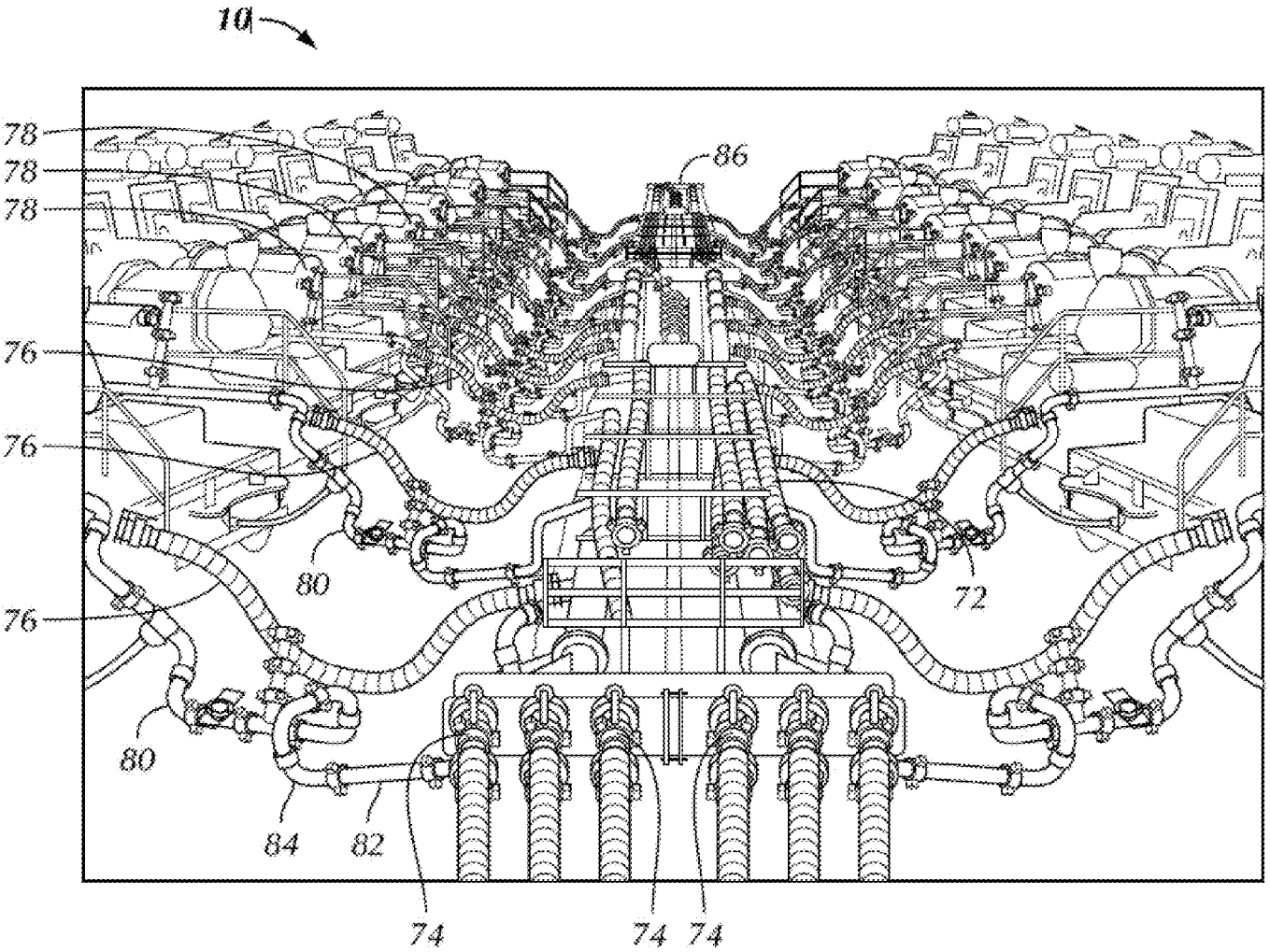
FIG.1
(PriorArt)

WELL FRACTURE SYSTEMS AND METHODS

BACKGROUND

In a well fracture system, high pressure fluid may be pumped from one or more pump trucks to one or more wellheads, via a pump manifold, a tree manifold, and/or other wellsite equipment. The well site equipment may be connected via rigid pipes, which may present several disadvantages.

The rigid pipes may not be connected between pieces of equipment along direct paths, but rather may be connected along redundant, angular paths, as shown in FIGS. 1-2. Swivel joints may be used to connect the rigid pipes in these paths. The redundant, angular paths may be necessary to compensate for misalignment between an inlet of a first piece of equipment and an outlet of a second piece of equipment. For example, the inlet and outlet may be horizontally and/or vertically offset from each other, or may be oriented at different angles. Such misalignment is common in wellsite equipment and will be discussed in more detail below. Redundant, angular connection paths may be required for rigid pipes to connect between a misaligned inlet and outlet.

The redundant, angular paths may also be necessary for the rigid pipes to withstand vibration caused by wellsite equipment, especially the pump trucks. Rigid pipes connected along direct paths may be at risk of breaking, especially at their junction points, due to the significant movement caused by the vibrations of the pump trucks. In contrast, the redundant, angular paths may allow the rigid pipes to better withstand the vibrations of the pump trucks.

Rigid pipes connected in redundant, angular paths may take up significant space at a wellsite and require significant time and personnel to assemble and disassemble. They may also include numerous points at which leaks or failure are likely because multiple pieces of rigid pipe may be joined together to connect the equipment. Each joint may be a weak point where leaks and/or failure may be more likely. These issues may be exacerbated if small diameter rigid pipes are used because multiple flow paths will be necessary to connect the first piece of equipment to the second piece of equipment. The redundant, angular paths may further make the rigid pipes susceptible to erosion, as a result of the numerous bends and angles associated with such connections.

SUMMARY OF THE DISCLOSURE

The present inventors have developed fracture systems that may include no or limited redundant, angular paths. Rather, fluid transport systems according to embodiments herein may include connections comprising flexible pipes, which do not require such tortuous paths, and methods of assembling and using these systems.

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the present disclosure relates to a method for performing simultaneous operations at a wellsite comprising two or more adjacent wellheads, each respectively connected to a well, which may include the following steps: providing a fluid supply via upstream equipment to an intermediate supply point; fluidly connecting the intermediate supply point to a single wellhead, the fluidly connecting comprising connecting a first end of a flexible pipe to the intermediate supply point and a second end of the flexible pipe to a first wellhead; performing a wellbore operation on a first well using the fluid supply from the upstream equipment supplied to the first wellhead; disconnecting the second end of the flexible pipe from the first wellhead; and connecting the second end of the flexible pipe to a second wellhead.

In another aspect, the present disclosure relates to a system for performing operations on adjacent wells. The system may include two or more pump trucks, a pump manifold consolidating a flow of fluid from the two or more pump trucks, two or more wellheads, and one or both of: a flexible pipe fluidly connecting the pump manifold to a single one of the two or more wellheads and a flexible pipe fluidly connecting, respectively, a high pressure outlet of each of the two or more pump trucks to the pump manifold.

In another aspect, the present disclosure relates a system for performing concurrent operations on adjacent wells. The system may include a first wellbore operation system for performing an operation on a first of the adjacent wells and a wellbore fracture operation system for performing a fracturing operation on a second of the adjacent wells. The wellbore fracture system may include two or more pump trucks, a pump manifold consolidating a flow of fluid from the two or more pump trucks, and a flexible pipe fluidly connecting the pump manifold to a single one of the adjacent wells.

In another aspect, the present disclosure relates a system for performing operations on adjacent wells. The system may include two or more pump trucks, a pump manifold consolidating a flow of fluid from the two or more pump trucks, two or more wellheads, a skid positioned between the pump manifold and the two or more wellheads. The skid may include a movable structure coupled to the skid and movable in a pre-defined pathway, two or more valves coupled to the skid and positioned to mimic the predefined pathway, each valve comprising an upstream connector point coupled to a different one of the two or more wellheads and a downstream connector point, and a flexible connection line coupled at a first end to the pump manifold or to an isolation valve coupled to the pump manifold and coupled proximate a second end to the movable structure. When the movable structure is moved in the pre-defined pathway, the second end of the flexible connection line may be positioned proximate only one of the two or more valves at a time.

In another aspect, the present disclosure relates a method for performing simultaneous operations at a wellsite comprising two or more adjacent wellheads, each respectively connected to a well. The method may include the following steps: providing a fluid supply via upstream equipment, connecting a first end of a flexible pipe to the upstream equipment, positioning a portion of the flexible pipe on a movable structure with a predefined pathway, moving the movable structure along the predefined pathway to align a second end of the flexible pipe with and sealingly secure to an end of a first fluid conduit in fluid communication with only a first wellhead, thereby establishing fluid communication between the fluid supply and only the first wellhead, disconnecting the second end from the end of the first fluid conduit, and moving the movable structure along the predefined pathway to align the second end of the flexible pipe with and sealingly secure to an end of a second fluid conduit in fluid communication with only a second wellhead, thereby establishing fluid communication between the fluid supply and only the second wellhead.

Other aspects and advantages will be apparent from the following description and the appended claims.

BRIEF DESCRIPTION OF DRAWINGS

FIGS. 1-2 are fracture systems in accordance with the prior art.

DETAILED DESCRIPTION

Figure 2:
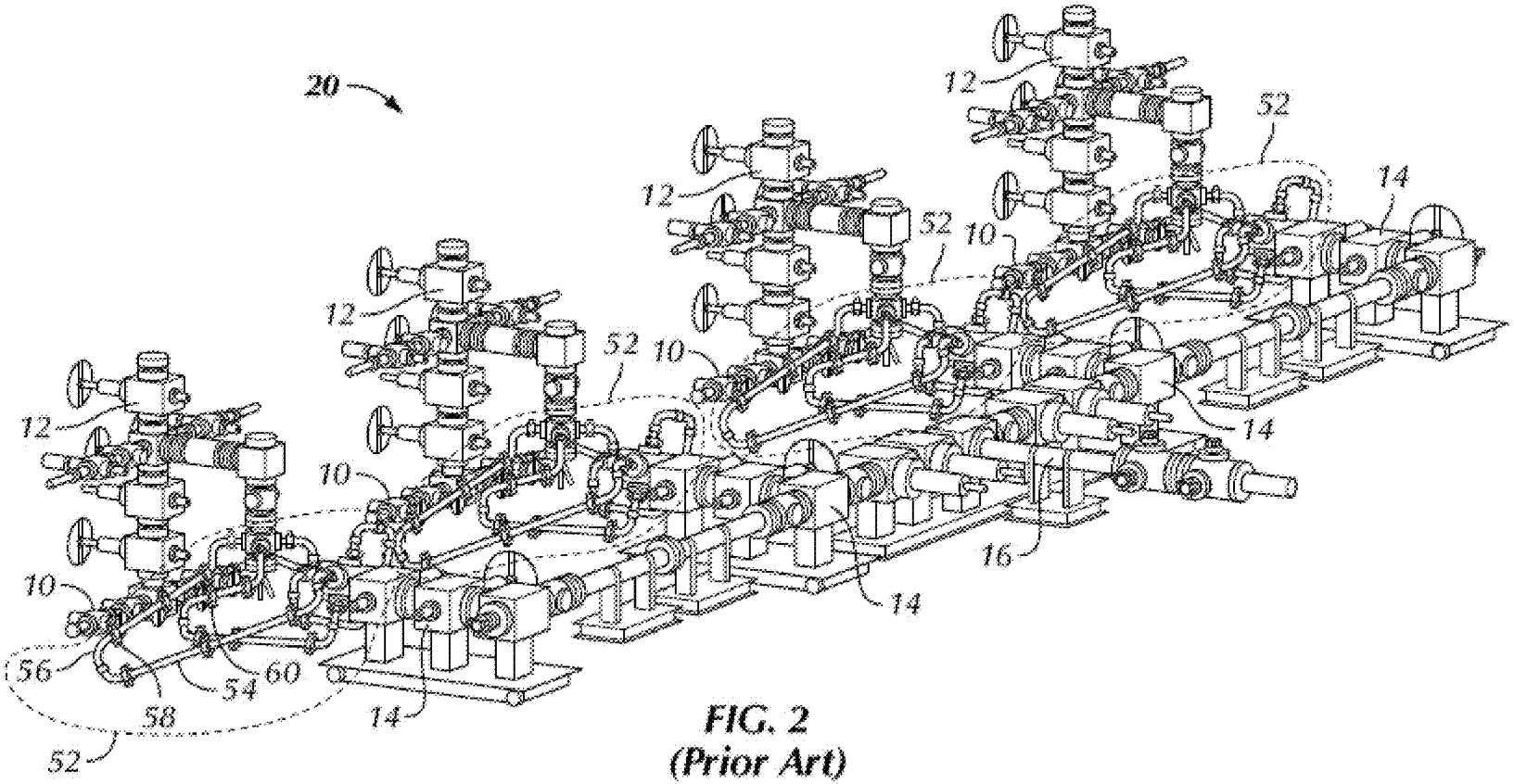
FIG. 2 (Prior Art)

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such.

Embodiments of the present disclosure generally relate to devices, systems, and methods for connecting pieces of wellsite equipment via flexible piping. The flexible piping may overcome the shortcomings of rigid pipes discussed above, and may allow equipment to be connected along relatively direct paths while forming strong seals and being resistant to damage caused by vibrations. The flexible piping may take up less space at a wellsite, require less time and personnel to install, and may have fewer potential leak paths and failure points. The flexible piping may allow connections to be made with a single larger flexible flowline, comprised of a single section of flexible piping, instead of multiple smaller rigid flowlines each comprised of multiple rigid pipes, thereby reducing complexity of the system and points at which damage may occur. Embodiments of the present disclosure may also include systems, devices, and methods for forming, breaking, and reforming connections made by flexible piping quickly.

In some embodiments, a single flexible pipeline may be used to first form a connection between a first piece of equipment and a second piece of equipment, and may then be disconnected from the second piece of equipment, and used to form a connection between the first piece of equipment and a third piece of equipment. This may allow the second piece of equipment and the third piece of equipment to be fully fluidly isolated from each other. In some embodiments, wellsite equipment such as a pump manifold or a tree manifold may be eliminated from the system. In general, systems and methods disclosed herein may reduce the complexity of wellsite equipment and operations, and improve their overall safety.

As discussed above, the present disclosure relates to wellsite systems and methods using flexible piping. In some embodiments, flexible piping may replace traditional rigid pipes which may carry high pressure fluid. FIGS. 1-2 illustrate traditional wellsite systems which may be used for fracturing operations.

FIG. 1 illustrates a pumping system 10, including a pump manifold 72. The pumping system may be configured to pump fracturing fluid, such as water containing sand and chemicals down one or more wellbores. Inlet lines 74 may carry low pressure fluid to the pump manifold 72. Low pressure lines 76 may carry the low pressure fluid from the pump manifold 72 to pump trucks 78. The low pressure lines 76 may be made of rubber or elastomeric hose, and may not be capable of withstanding high pressures. The pump trucks 78 may pump the fluid and thereby pressurize it to a high pressure. The high pressure fluid may be returned to the pump manifold 72 via high pressure lines 80. The high pressure lines 80 may comprise rigid piping components 82 connected via swivel joints 84. The rigid piping components 82 may be necessary to withstand the high pressures. As illustrated in FIG. 1, the high pressure lines 80 may not connect the pump trucks 78 to the pump manifold 72 along direct paths, but may instead follow redundant, angular paths. The redundant, angular paths may be used so as to enable the high pressure lines 80 to better absorb the vibrations imparted to them via the pump trucks. The high pressure fluid may flow through the pump manifold 72 to an isolation valve 86, which may in turn be connected to a well manifold (see FIG. 2).

FIG. 2 illustrates a fracture system 20 in which connections are made between Christmas trees 12 and a frac manifold 14 using flowline paths 52. The flowline paths 52 may each be composed of one or more rigid pips, which may include straight segments 54 and angled segments 56. The piping components may be connected to each other using swivel joints 58. Typically, the frac manifold 14 is assembled and then connected to the trees 12 using the flowline paths 52. The segments 54, 56 and the swivel joints 58 collectively provide adjustability in the flowline paths 52 that facilitate connections between frac manifold 14, which is not necessarily in strict alignment with the trees 12, and the trees 12. As depicted, more than one flowline path 52 may be connected between each Christmas tree 12 and the frac manifold 14 to provide the necessary flow volume for a fracturing operation. These multiple connections may occupy a significant amount of space in the fracture system 20, and may require a significant amount of time and personnel to assemble, test, and disassemble.

The pumping system 10 illustrated in FIG. 1 and the fracture system 20 illustrated in FIG. 2 may be used together to fracture one or more wellbores. In some embodiments, one system 10, 20 may be used without the other and may instead be used with other wellsite equipment.

FIGS. 3-6 illustrate embodiments of a connection system in accordance with the present disclosure. The embodiments of the connection system may be used alone or two or more embodiments may be used together. Different embodiments also illustrate different details. One skilled in the art will recognize that each embodiment could be practiced with details illustrated in a different embodiment without departing from the scope of the disclosure.

Figure 3:
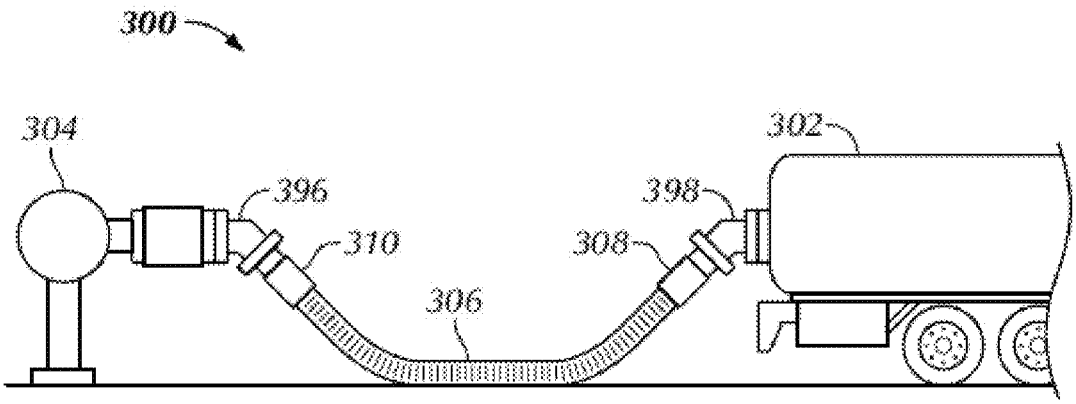
FIGS. 3-7 are connection systems in accordance with embodiments of the present disclosure.
Figure 4:
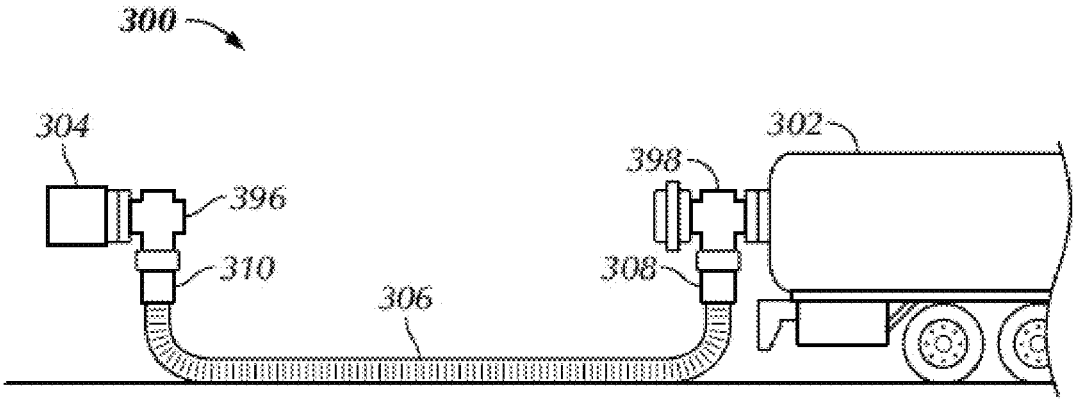

FIGS. 3-4 illustrate connection systems in which a flexible piping system is used to connect a pump truck to a pump manifold. In these systems, the flexible piping system may be used to carry high pressure fluid from the pump trucks to the high pressure pump manifold. The systems may include other components, such as the flexible hosing carrying low pressure fluid, which are not illustrated in FIGS. 3-4.

FIGS. 3-4 illustrate a connection system 300 for connecting a pump truck 302 to a high pressure pump manifold 304. The connection system 300 comprises a flexible connection line 306. A first end 308 of the connection line 306 may be connected to the pump truck 302, receiving the high pressure discharge from the pump, and a second end of the connection line 310 may be connected to the pump manifold 304.

The flexible connection line 306 may be a pipeline having multiple layers. In some embodiments, the flexible connection line 306 may be any type of flexible pipeline known in the art. The flexible connection line 306 may be made of a material having sufficient strength to withstand high pressures, such as the pressures at which fracture fluids are injected into a wellbore, which may be as high as 15,000 psi in some embodiments. The flexible connection line 306 may also have sufficient flexibility and length to account for offsets in alignment between the pump truck 302 to the pump manifold 304. For example, an outlet of the pump truck 302 may be higher than, lower than, or laterally offset from an inlet of the pump manifold 304. An outlet of the pump truck 302 may also be disposed at an angle to an inlet of the pump manifold 304. The flexible connection line 306 may be able to bend sufficiently to connect to both the outlet of the pump truck 302 at a first end 308 and to the inlet of the pump manifold 304 at a second end 310, even if the inlet and outlet are not perfectly aligned with each other. The flexibility of the flexible connection line 306 may allow the ends 308, 310 of the connection line 306 to be oriented directly towards the pump truck 302 and the pump manifold 304 as shown in FIGS. 3-4, so that strong seals may be formed.

In some embodiments, a portion of the flexible connection line 306 may be in contact with the ground. This may help to support the weight of the flexible connection line 306 and to avoid placing undue pressure on the connections between the flexible connection line 306 and the pump truck 302 and the manifold trailer 304. The flexible connection line 306 may bend downwards from each connection point to the ground in such embodiments. To account for the vibrations resulting from the pumping, the flexible pipe disposed between the pump truck and the manifold is not installed in a direct route; rather, the length of the flexible pipe disposed on the ground may be configured in an "s" shape. The "s" shape may allow the flexible piping to flex along with the pumping, and the gentle curves of the "s" may provide for less erosion than would occur in rigid connections including multiple bends to account for the vibrations. The additional length provided by the "s" may also allow for ease in the connection to be re-made with a new pump truck, should a pump fail; as the pump trucks will not always have similar connections, or may not be located at the exact point when moved and placed for use, the "s" allows for the connections to be made without concern for differences in vertical and/or horizontal placement of the high pressure pump outlet connection. An "s" shape may refer to any shape comprising a curve in a first direction and an adjacent curve in an opposite direction. The curves may have any radius of curvature, and the radii of curvature may or may not be the same.

The ends 308, 310 of the flexible connection line 306 may be connected to the pump truck 302 and the manifold trailer 304 via connectors 396, 398 that promote the downward turning of the flexible connection line 306. These connectors may reduce the amount of force placed on the pump truck 302 and the manifold trailer 304, and thereby reduce damage to the equipment. The connectors may further reduce the radius of any bends which the flexible connection line 306 is forced to make, thereby reducing the stress on the flexible connection line 306 and/or the necessary length of the flexible connection line 306. FIG. 3 illustrates an embodiment in which the connectors are angle connectors, which may form 30 to 60 degree angles, such as 45 degree angles, and which are discussed in more detail with respect to FIG. 9. FIG. 4 illustrates an embodiment in which the connectors are elbow connectors which may form 90 degree angles.

The connectors 396, 398 may increase the speed and ease with which connections between the flexible connection line 306 and other equipment may be made. In some embodiments, the connectors 396, 398 may include or may be used in conjunction with an alignment mechanism and/or a "quick connect" mechanism, such that if an end of the flexible connection line 306 is lifted into proximity with a connector, i.e. by hand or by a crane, the end of the flexible connection line 306 may readily and quickly connect to the connector 396, 398. In some embodiments, the flexible connection line 306 may not require any manipulation beyond being lifted, by hand or by a crane, to form a strong connection/seal. This may represent a significant reduction in time and personnel requirements, compared to the standard connections using rigid pipes. It may also represent an increase in safety because it may reduce the number of personnel who are required to make the connection and who are potentially exposed to the high pressure flow of fracture fluid.

As discussed above, prior art systems for connecting pump trucks to pump manifolds use pipe segments of varying lengths and curvatures connected by swivel joints to account for offsets in alignment between the Christmas trees and the equipment. As shown in FIG. 1, such systems may require significant amounts of piping components to compensate for offsets in alignment. The piping components may require significant personnel and time to design, assemble and disassemble, have numerous points at which leaks and failure are likely, and may take up a significant amount of space. In contrast, in the connection system 300, any offsets in alignment may be compensated for by the flexible connection line 306. In this way, the connection system 300 may require less time and/or personnel to assemble and disassemble, have fewer points at which leaks and failure are likely, and may take up less space than standard connection systems. Further, design of the overall piping system may be minimized, as the configuration and alignment of multiple pipes is eliminated, requiring only a consideration of overall length and the necessary "s" for vibration damping.

Connection systems 300 using including flexible connector lines 306 may present several advantages over traditional systems for connecting pumping equipment at a wellsite. The flexible connector lines may be able to be connected along relatively direct paths, which are not angular or redundant. They may be able to withstand vibrations imparted to them by the pump trucks without being damaged. They may also be able to be account for lateral or angular offsets between the inlet of the pump manifold and the outlet of the pump truck. This may allow the pump trucks to be parked more closely together because precise alignment with the pump manifold may be less of an issue. This may in turn allow a smaller pump manifold to be used. A connection system 300 may be readily assembled at a traditional pumping site, such as that shown in FIG. 1, by replacing the rigid pipes of the high pressure lines 80 with flexible piping. In some cases, no other changes may be needed to update the system.

Figure 5:
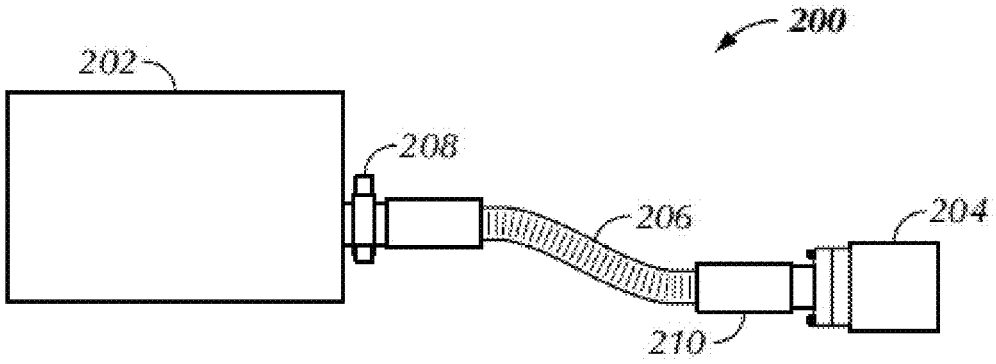
Figure 6:
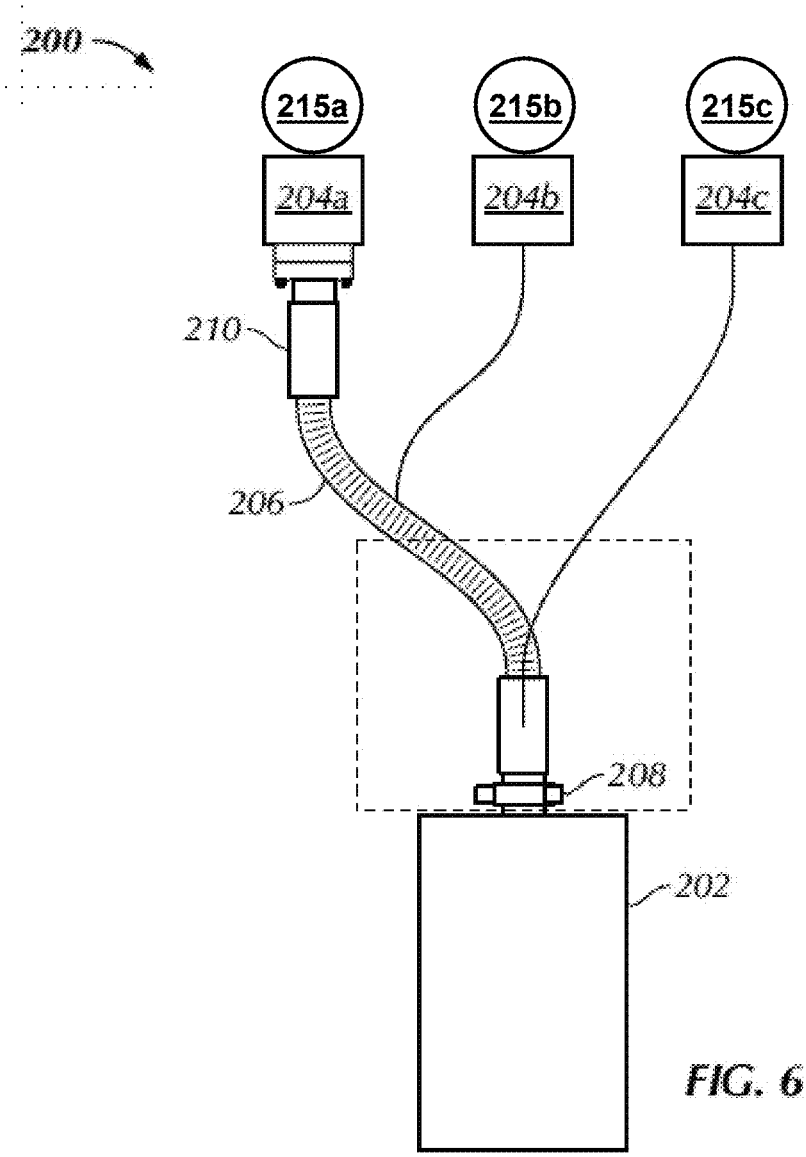
Figure 7:
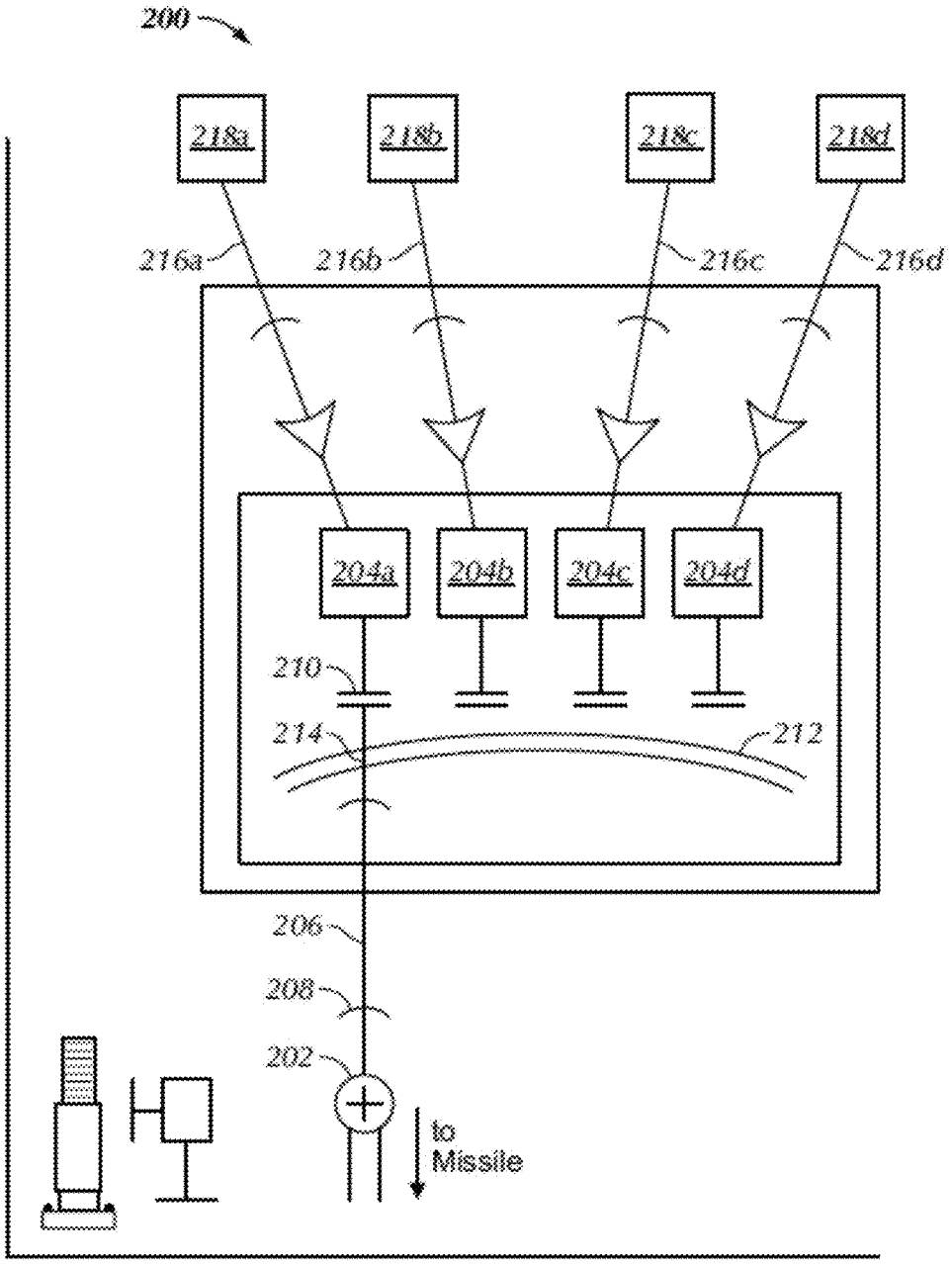

FIGS. 5-7 illustrate connection systems in which flexible piping system is used to connect a Christmas tree to wellsite equipment upstream of the Christmas tree. Example wellsite equipment upstream of the Christmas tree includes but is not limited to, pump manifolds, high pressure pumps, and isolation valves that may be immediately downstream of a pump manifold or other wellsite equipment. In these systems, the flexible piping system may be used to carry high pressure fluid from the wellsite equipment to the Christmas tree. These systems may eliminate the need for the tree manifolds illustrated in FIG. 2. In some embodiments, some of the equipment which may have previously been included in a frac manifold may be directly connected to the Christmas trees. In some embodiments, flexible piping system may be connected directly from one or more pump trucks or the pump manifold to one or more Christmas trees. In other embodiments, neither a pump manifold nor a frac manifold may be used.

FIG. 5 illustrates a connection system 200 for connecting an isolation valve 202 to a Christmas tree 204. Although an isolation valve 202 is illustrated in this embodiment, one skilled in the art will recognize other types of fracture equipment or wellbore equipment could be substituted for the isolation valve 202 without departing from the scope of the present disclosure, such as connection to a high pressure discharge end of a pump manifold (not shown). The equipment used in this position may be considered an intermediate supply point and may include equipment such as a pump manifold, an isolation valve, or other equipment or connections that may be associated with flow by one skilled in the art. The connection system 200 comprises a flexible connection line 206. A first end 208 of the connection line 206 may be connected to the isolation valve 202 and a second end of the connection line 210 may be connected, directly or indirectly, to the Christmas tree 204.

The flexible connection line 206 may be a pipeline having multiple layers, which may be metal layers, elastomeric layers, or both. In some embodiments, the flexible connection line 206 may be any type of flexible pipeline known in the art. The flexible connection line 206 may be made of a material having sufficient strength to withstand high pressures, such as the pressures at which fracture fluids are injected into a wellbore. The flexible connection line 206 may also have sufficient flexibility and length to account for offsets in alignment between the isolation valve 202 and the Christmas tree 204. For example, an outlet of the isolation valve 202 may be higher than, lower than, or laterally offset from an inlet of the Christmas tree 204. An outlet of the isolation valve 202 may also be disposed at an angle to an inlet of the Christmas tree 204. The flexible connection line 206 may be able to bend sufficiently to connect to both the outlet of the isolation valve 202 at a first end 208 and to the inlet of the Christmas tree 204 at a second end 210, even if the inlet and outlet are not perfectly aligned with each other. The flexibility of the flexible connection line 206 may allow the ends 208, 210 of the connection line 206 to be oriented directly towards the isolation valve 202 and the Christmas tree 204, so that strong seals may be formed.

In some embodiments, a portion of the flexible connection line 206 may be in contact with the ground. This may help to support the weight of the flexible connection line 206 and to avoid placing undue weight on the connections between the flexible connection line 206 and the isolation valve 202 and the Christmas tree 204. The flexible connection line 206 may bend downwards from each connection point to the ground in such embodiments.

As discussed above, present systems for connecting Christmas trees to drilling equipment use pipe segments of varying lengths and curvatures connected by swivel joints to account in offsets in alignment between the Christmas trees and the equipment. As shown in FIG. 2, prior art systems may require significant amounts of piping components to compensate for offsets in alignment. The piping components may require significant personnel and time to design, assemble and disassemble, have numerous points at which leaks and failure are likely, and may take up a significant amount of space. In contrast, in the connection system 200, any offsets in alignment may be compensated for by the flexible connection line 206. In this way, the connection system 200 may require less time and/or personnel to assemble and disassemble, have fewer points at which leaks and failure are likely, and may take up less space than standard connection systems.

The flexible connection line 206 may have a diameter sufficient to carry the entire volume of fluid necessary from the isolation valve 202 to the Christmas tree 204. In this way, the flexible connection line 206 may be used as a monoline, or in other words, may be a single flowline connecting the isolation valve 202 to the Christmas tree 204. In some embodiments, the flexible connection line 206 may have a diameter between two and seven inches, between three and six inches, or between three and four inches. As compared to current systems which use multiple parallel flowlines to form connections, a monoline configuration has several advantages. A monoline connection may require less time and/or personnel to assemble and disassemble, have fewer points at which leaks and failure are likely, and may take up less space.

The flexible connection line 206 may be connected to the isolation valve 202 and to the Christmas tree 204 via metal-to-metal seals. Metal-to-metal seals may be stronger than elastomeric seals or nut seals, which are used in traditional connection systems. Metal-to-metal seals may also require less time and/or personnel to assemble and disassemble than elastomeric seals or nut seals. Thus, the connection system 200 may be less prone to leaks and failure, and may require less time to assemble and disassemble than traditional connection systems. In some embodiments, the connections in the connection system 200 may be made by other types of seals.

In some embodiments, the connection system 200 may include a valve (not shown) disposed between the isolation valve 202 and the Christmas tree 204. The valve may be an isolation valve, a check valve, or any other type of valve known in the art. In some embodiments, the valve may be disposed at the first end 208 or the second end 210 of the flexible connection line 206. The valve may allow the Christmas tree 204 and the attached wellhead (not shown) to be isolated from the isolation valve 202 or other upstream equipment.

The connection system 200 may be used to connect the isolation valve 202 to the Christmas tree 204 without an intermediate frac manifold. Not having a frac manifold in the system 200 may reduce the complexity of the system and the number of potential failure points. It may also make the system 200 easier, faster, and/or less expensive to install and operate. The lack of a frac manifold may also eliminate concerns with regard to exposure of other Christmas trees to high pressure fluid due to incorrect manifold valve operation.

In the embodiment discussed above, the connection system 200 is used to connect an isolation valve or other upstream equipment, such as a pump manifold, to a single Christmas tree, either directly or indirectly. The system 200 may also be used to alternately connect an isolation valve or other equipment to multiple Christmas trees. FIG. 6 illustrates such an embodiment.

FIG. 6 illustrates a connection system 200 which may be used to alternately connect an isolation valve 202 to one of three Christmas trees 204*a*, 204*b*, 204*c*. The connection system 200 may include a flexible connection line 206 having a first end 208 and a second end 210 as described above. The connection system 200 may include valves and/or metal-to-metal seals as described above. Each of the Christmas trees 204*a*, 204*b*, 204*c* may be connected to a wellhead (215*a*, 215*b*, and 215*c*), such that Christmas trees 204*a* is attached to wellhead 215*a*, Christmas trees 204*b* is attached to wellhead 215*b*, and Christmas trees 204*c* is attached to wellhead 215*c*. Although FIG. 6 illustrates an embodiment of the system 200 in which an isolation valve 202 is connected to three Christmas trees 204*a*, 204*b*, 204*c*, one skilled in the art will recognize that the system 200 may be used to connect different types of equipment to Christmas trees without departing from the scope of the present disclosure.

The first end 208 of the flexible connection line 206 may be connected to the isolation valve 202. The second end 210 of the flexible connection line may be alternately connected to each of the Christmas trees 204*a*, 204*b*, 204*c*. FIG. 6 illustrates the second end 210 connected to the first Christmas tree 204*a*. The system 200 may be configured such that the second end 210 may be disconnected from the first Christmas tree 204*a* and connected to the second or third Christmas tree 204*b*, 204*c*.

The flexible connection line 206 may have sufficient length and flexibility to connect to all of the three Christmas trees 204*a*, 204*b*, 204*c*. The length of the flexible connection line 206 may be governed substantially by the distance from the most distal Christmas tree 204*a*, 204*b*, 204, to the isolation valve 202. If it is desired that a portion of the flexible connection line 206 rest on the ground, the system 200 may be configured such that the flexible connection line 206 may rest on the ground when connected to any of the Christmas trees 204*a*, 204*b*, 204*c*.

The second end 210 of the flexible connection line 206 may be moved between the Christmas trees 204*a*, 204*b*, 204*c* by any means known in the art when it is not connected to a Christmas tree 204*a*, 204*b*, 204*c*. The system 200 may be configured such that the flexible connection line 206 may be moved by a crane, a cart, a forklift, or by other means. The first end 208 of the flexible connection line 206 may be connected to the isolation valve 202 or other upstream equipment while the second end 210 of the flexible connection line 206 is moved between Christmas trees 204*a*, 204*b*, 204*c*.

While the flexible connection line 206 is connected to one of the Christmas trees 204*a*, operations may be performed on that Christmas tree 204*a*. While such a connection is made, fluid may be incapable of being provided to the other Christmas trees 204*b*, 204*c* from the upstream equipment attached to the flexible connection line 206. This stands in contrast to a traditional manifold and isolation valves, which can fail or inadvertently be opened, exposing the other Christmas trees 204*b*, 204*c* and attached wellheads 215*b*, 215*c*, to the fluid supply. Rather, the fluid supply is provided to the first Christmas tree 204*a* and first wellhead 215*a*, and only to the first Christmas tree 204*a* and first wellhead 215*a*, and cannot be inadvertently routed to the second, etc. wells, as there is no fluid pathway provided for such an occurrence.

FIG. 7 illustrates an embodiment of the connection system 200 in which the flexible connection line 206 is moved by a cart on a track. The connection system 200 may connect an isolation valve 202 to Christmas trees 204*a*, 204*b*, 204*c*, 204*d* and may include a flexible connection line 206 having a first end 208 and a second end 210 as described above. The connection system 200 may include valves and/or metal-to-metal seals as described above. Each of the Christmas trees 204*a*, 204*b*, 204*c*, 204*d* may be connected to a wellhead (not shown). Although FIG. 7 illustrates an embodiment of the system 200 in which an isolation valve 202 is connected to four Christmas trees 204*a*, 204*b*, 204*c*, 204*d* one skilled in the art will recognize that the system 200 may be used to connect different types of equipment to any number of Christmas trees without departing from the scope of the present disclosure.

The first end 208 of the flexible connection line 206 may be connected to the isolation valve 202. The second end 210 of the flexible connection line may be alternately connected to each of the Christmas trees 204*a*, 204*b*, 204*c*, 204*d*, to allow the desired fluid communication between the upstream equipment, such as frac pumps and pump manifolds (not illustrated) and the well. It should also be appreciated that a flexible connection line similar to the flexible connection line 206 may be used to connect the isolation valve 202 to the upstream equipment, as well as fluidly connect other upstream elements to each other. Upon completion of the operation, the flexible connection line 206 may be moved to tree 204*b*, 204*c*, or 204*d*, for an operation on that well. FIG. 7 illustrates the second end 210 connected to the first Christmas tree 204*a*. The system 200 may be configured such that the second end 210 may be disconnected from the first Christmas tree 204*a* and connected to the second, third, or fourth Christmas tree 204*b*, 204*c*, 204*d*.

The flexible connection line 206 may be connected to or disposed on a cart 214. In some embodiments, the flexible connection line 206 may be connected to the cart 214 at a point proximate the second end 210. The cart 214 may be any type of cart, trolley, or other vehicle known in the art which is capable of holding the weight of the flexible connection line 206. In some embodiments, the cart 214 may be disposed on a track 212 such that the cart may move along the path defined by the track 212. The track 212 may include a mechanism (not shown) by which the cart 214 may be locked into a position proximate each of the Christmas trees 204*a*, 204*b*, 204*c*, 204*d*. In some embodiments, the system 200 may not include a track 212 and the cart 214 may be able to be driven or moved around freely.

The path and curvature of the track 212 may be governed in part by the spacing and location of the Christmas trees 204*a*, 204*b*, 204*c*, 204*d* and by the flexibility of the flexible connection line 206. In some embodiments, the track 212 may be radial, such that the second end 210 of the flexible connection line 206 may move in a radial direction mimicking the track 212. In some embodiments, the track 212 may have multiple degrees of curvature, such that the second end 210 of the flexible connection line 206 may extend and retract as the cart 214 moves along the track. The connection system 200 may further include mechanisms (not shown) such as a hydraulic or mechanical jack which may bring the second end 210 of the flexible connection line 206 into alignment with the connection point by raising or lowering the cart 214 on the track 212. In some embodiments, the track 212 may be reconfigurable, such that the track 212 may be arranged into different paths to allow the second end 210 of the flexible connection line 206 to reach different points.

In general, the cart and/or track system may be used to facilitate movement of the flexible piping system between Christmas trees, allowing both fluid isolation of the tree for which the high pressure operation is being conducted and rapid movement of the flexible piping between adjacent or nearby trees. The configuration of the pipe from the upstream connection point to the cart may include sufficient length to extend to the furthermost point on the track and an "s" bend as necessary to provide for movement at nearer well connection points. The flexible piping system may also include sufficient length and any necessary "s" bends to similarly allow movement and connection of the flexible piping system to the nearest and further tree from the cart or track.

In some embodiments, the second end 210 of the flexible connection line 206 may not be connected directly to the Christmas trees 204*a*, 204*b*, 204*c*, 204*d*. The second end 210 may instead be connected to extension lines 216*a*, 216*b*, 216*c*, 216*d* which may be connected to the Christmas trees 204*a*, 204*b*, 204*c*, 204*d*. The extension lines 216*a*, 216*b*, 216*c*, 216*d* may be rigid pipe or, in some embodiments, may be made of a flexible piping system material similar to that of the flexible connection line 206. In some embodiments, the extension lines 216*a*, 216*b*, 216*c*, 216*d* may extend horizontally and/or vertically downward from an upper point of the Christmas tree, such that a lower end of each extension line is configured to be readily connected to the flexible connector line 206.

In some embodiments, the extension lines 216*a*, 216*b*, 216*c*, 216*d* may individually be coupled to the flexible connector line 206 to facilitate fluid communication between frac pumps, pump manifolds, or other upstream equipment and the trees 204*a-d*. As depicted, the extension lines 216*a*, 216*b*, 216*c*, 216*d* may individually be coupled to the flexible connector line 206 through one or more valves 218*a*, 218*b*, 218*c*, 218*d*. In some embodiments, the valves 218*a*, 218*b*, 218*c*, 218*d* may be coupled to a fixed surface, such as the ground, and arranged to mimic the path of the track 212. Each of the valves 218*a*, 218*b*, 218*c*, 218*d* may comprise one or more connector points, such as flanges or connector hubs, that facilitate connection to the extension lines 216*a*, 216*b*, 216*c*, 216*d* and to the flexible connector line 206. The second end 210 of the flexible connector line 206 may be connected to and retracted from the connector points on the valves 218*a*, 218*b*, 218*c*, 218*d* partially via the movement of the cart 214 along the track 212. Connection and retraction may be performed without damage to the connector points the valves 218*a*, 218*b*, 218*c*, 218*d* or the second end 210 of the flexible connection pipe 206. Although FIG. 7 illustrates an embodiment of the system 200 including extension lines 216*a*, 216*b*, 216*c*, 216*d*, one skilled in the art will recognize that the system 200 may include a cart 214 and a track 212 without including extension lines 216*a*, 216*b*, 216*c*, 216*d*. In some embodiments, the flexible connector line 206 is arranged proximate a connector point, it may need merely to be lifted by a crane to be connected to the extension line 216*a*, 216*b*, 216*c*, 216*d*.

In some embodiments, the flexible connection line 206 may be moved by a forklift, a crane, and/or any other means known in the art. The connection line 206 may include lift points (not shown) configured to cooperate with the forklift, crane, or other moving equipment. The lift points may comprise interchangeable equipment which may be easily added to or removed from the flexible connection line 206. The necessary lift points may be added to a flexible connection line 206 to allow the line 206 to cooperate with the moving equipment available at a given well site.

In certain embodiments, the valves 218*a*, 218*b*, 218*c*, 218*d* and their associated connector points may be coupled to the same fixed surface as the track 212, such as a skid or other structure, with the position of the valves 218*a*, 218*b*, 218*c*, 218*d* and their associated connector points being fixed with respect to the track 212. In certain embodiments, the valves 218*a*, 218*b*, 218*c*, 218*d* and their associated connector points, the track 212 and the cart 214 may be coupled to the fixed surface, such as a skid, that is transported to the wellsite as a unit. Once at the wellsite, extension lines 216*a*, 216*b*, 216*c*, 216*d* may be connected to their respective trees and downstream valve connector points, and flexible connector line 206 may be coupled to the cart 214. Then, the cart 214 may be moved along the track until end 210 of the flexible connector line 206 is positioned proximate an upstream connection point for one of the valves 218*a*, 218*b*, 218*c*, 218*d*. End 210 of the flexible connector line 206 may then be brought into sealing engagement with and secured to the upstream connection point for one valve, creating a single fluid pathway between the isolation valve/fluid source and the tree to which the valve is connected by an extension line, while leaving the other trees/valves/extension lines completely decoupled from the isolation valve/fluid source. Once frac operations are completed on the first tree, the end 210 of the flexible connector line 206 may be disconnected and retracted from the upstream connection point of the valve, and thereby moved, via the cart/track proximate the upstream connector point of a different valve. The end 210 of the flexible connector line 206 may then be brought into sealing engagement with and secured to the upstream connection point of the second valve, creating a single fluid pathway between the isolation valve/fluid source and the tree to which the second valve is connected by an extension line, while leaving the other trees/valves/extension lines, including the first tree/valve/extension line to which the end 210 was connected completely decoupled from the isolation valve/fluid source. In certain embodiments, the end 210 of the flexible connector line 206 may be pushed into sealing engagement with or retracted from the upstream connectors of the valves 218*a*, 218*b*, 218*c*, 218*d* using hydraulic, mechanical, or any type of mechanism coupled to the flexible connector line 206, skid, track, etc. The retraction may be facilitated by flexibility of the flexible connector line 206.

Figure 8:
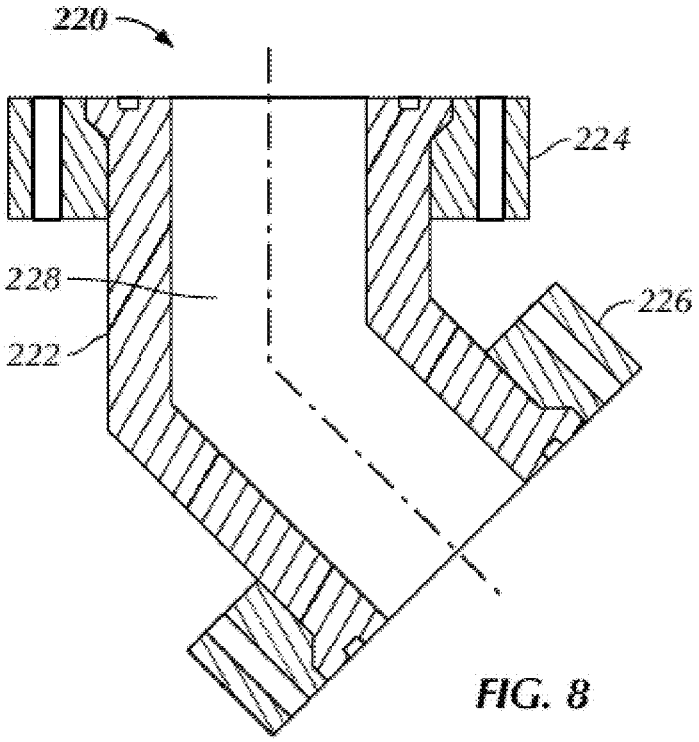
FIGS. 8-9 are connectors in accordance with embodiments of the present disclosure.
Figure 9:
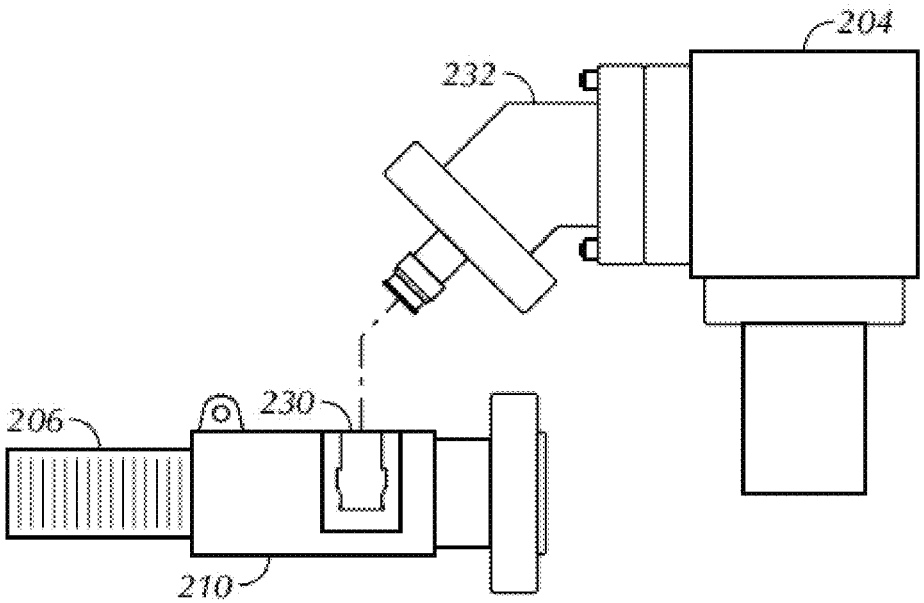

As discussed above, connections are formed between the ends 208, 210 of the flexible connection line 206 and the isolation valve 202 or other upstream equipment and the Christmas trees 204. These connections may include strong metal-to-metal seals and may be readily made up and broken apart. FIGS. 8-9 illustrate optional equipment which may be included in the connection system 200 to facilitate the connections.

FIG. 8 illustrates an angled spool connector 220. The angled spool connector may comprise an angled body 222, a first flange 224, and a second flange 226. The angled body 222 may have a bore 228 formed therethrough and the diameter of the bore may be the same or similar to the diameter of the diameter of the flexible connection line 206. The angled body 222 may be curved or bent, such that the first flange 224 is disposed at an angle to the second flange 226. In some embodiment, that angle may be between zero and ninety degrees, between twenty and sixty degrees, or between thirty and forty-five degrees.

With reference to FIGS. 3-7, the first flange 224 may be connected to the Christmas tree 204 or the isolation valve 202 and the second flange 226 may be connected to an end 208, 210 of the flexible connector line 206. Either the first flange 224 or the second flange 226 may be removably connected, such that the connection may be quickly made and/or broken via that flange 224, 226. The other flange 224, 226 may be connected in a more permanent manner. In some embodiments, both flanges 224, 226 may be removably connected. This may allow the connections between the flexible connector line 206 and the Christmas tree 204 and the isolation valve 202 to be quickly made and broken.

The angled spool connector 220 may facilitate connections in embodiments in which the flexible connection line 206 curves downward from the connection points to rest on a cart or the ground. The angled spool connector 220 may reduce the stress placed on the connections by the downward curve/bend. In this way, the angled spool connector may help allow strong metal-to-metal seals to be formed and may prevent failure of the connection system 200, thereby extending its lifespan and reducing the need for repairs.

FIG. 9 illustrates a connector bracket 232 and a connector fitting 230 configured to be readily connected and disconnected and to facilitate strong metal-to-metal seals. The connector bracket 232 may be disposed on an inlet or outlet of the Christmas tree 204. The connector fitting 230 may be disposed on the second end 210 of the flexible connector line 206. The bracket 232 and fitting 230 may comprise an alignment mechanism which may allow the flexible connector line 206 to be readily aligned with and connected to the Christmas tree 204. The bracket 232 may be angled and may be adjustable to be disposed at different angles. In some embodiments, placement of the bracket 232 and the fitting 230 may be reversed. Lifting of the flexible piping system 206 end 210, such as via crane lift point, may thus readily align the end 210 of the flexible piping system with the inlet to tree 204 for rapid connection.

The connection system 200 may also include a cradle or other alignment mechanism (not shown). The cradle may extend below the point to which the flexible connection line 206 is to be connected. The cradle may guide/align the end of the flexible connection line 206 as it is lifted into a position proximate the connection point. In some embodiments, the flexible connection line 206 may be lifted by a crane or a forklift. The cradle may include an angled or sloped surface along which the end of the flexible connection line 206 may slide. The sloped or angled surface may comprise a material which allows the end of the flexible connection line 206 to slide without causing damage to the surface or the flexible connection line 206. The cradle may allow the flexible connection line 206 to be fully aligned with the connection point without further alignment mechanisms or operations, or the cradle may be used in conjunction with other alignment mechanism or operations.

The connection system 200 described above includes a flexible connection line 206 having a first end 208 which may be connected to an isolation valve or other wellbore equipment and a second end 210 which may be connected to a Christmas tree 204. The connection system 200 has been described having the second end 210 moveable between multiple Christmas trees 204 and having the first end 208 substantially stationary. However, one skilled in the art will readily envision that such a system may be implemented with the first end 208 moveable and the second end 210 substantially fixed or with both the first end 208 and the second end 210 moveable. Such an implementation is within the scope of the present disclosure.

Figure 10:
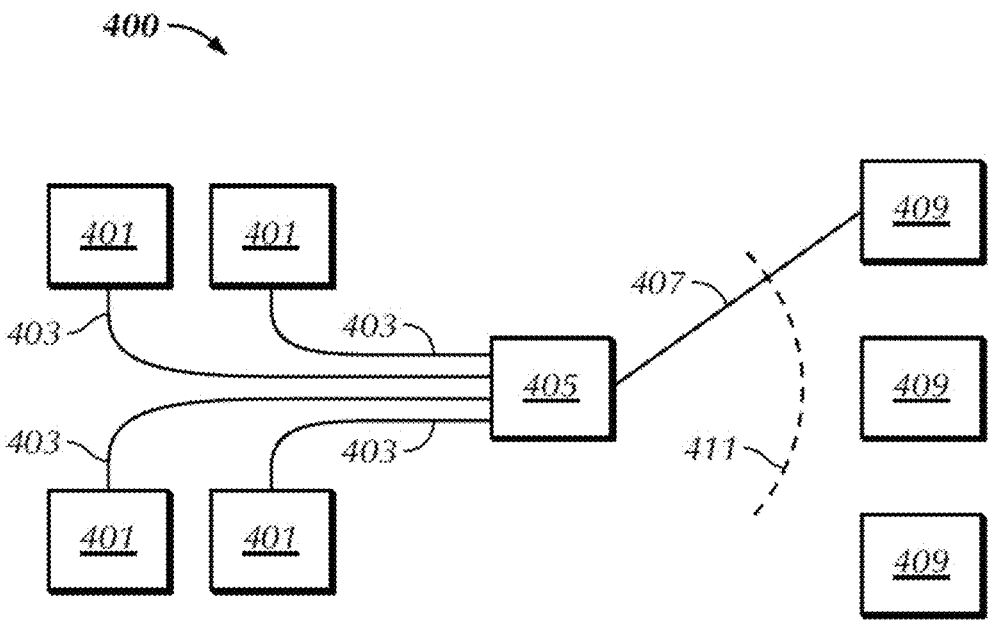
FIG. 10 is a connection system in accordance with embodiments of the present disclosure.

FIG. 10 illustrates an embodiment of the connection system which includes one or more flexible connection lines connecting one or more pump trucks to manifold and a single flexible connection line which may be connected to and disconnected from one or more wellheads.

FIG. 10 illustrates a connection system 400 in which one or more pump trucks 401 are connected to a manifold 405, and the manifold 405 is in turn connected to one or more wellheads 409. Each of the one or more pump trucks 401 may be connected to the manifold 405 via a flexible connection line 403. The flexible connection lines 403 may be capable of carrying high pressure fluid. The flexible connection lines 403 may be disposed on the ground, on a pipe rack (not shown), or on another support structure. Such a configuration of flexible connection lines 403 may take up significantly less space than a typical pump manifold, such as that illustrated in FIG. 2. The configuration may also allow the pump trucks 401 to be arranged in any positions desired, because the positions of the pump trucks 401 are not dictated by rigid configuration of the pump manifold. The pump trucks 401 may be arranged in a manner best suited to the wellsite.

The manifold 405 may be alternately connected to one or more wellheads 409 via a flexible connection line 407. The flexible connection line 407 may be disconnected from a first wellhead 409 and connected to a second wellhead 409. In some embodiments, the flexible connection line 407 may not be connected directly to the wellheads 409, but rather may be connected to a Christmas tree (not shown) disposed on a wellhead, or a connector (not shown) attached to a Christmas tree. The flexible connection line 407 may from one wellhead 409 to another along a track 411 or by any other means known in the art.

The present disclosure also relates to methods of performing wellbore operations using the connection system described above. An exemplary method in accordance with the present disclosure is described below with reference to FIGS. 3-7 and 10. One skilled in the art will recognize that a method in accordance with the present disclosure may not include every step described below and may include additional steps not described below. Additionally, the method described below includes two wellheads, but one skilled in the art will recognize that it may be readily modified to include any number of wellheads.

Figure 11:
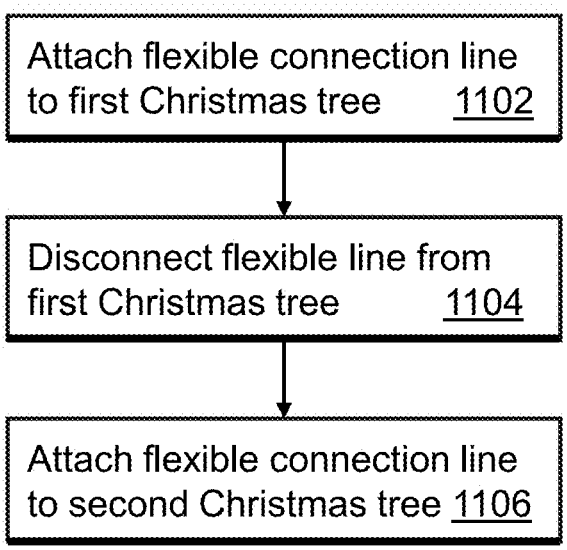
FIGS. 11 and 12 are flow charts in accordance with embodiments of the present disclosure.

FIG. 11 outlines a method in accordance with the present disclosure. A flexible connection line may be attached to upstream equipment at a first end. In a first step 1102, a second end of the flexible connection line may be attached to a first Christmas tree 204*a*. In a second step 1104, the second end of the flexible connection line may be detached from the first Christmas tree 204*a*. In a third step 1106, the second end of the flexible connection line may be attached to a second Christmas tree 215*b*. A more detailed series of steps also in accordance with the present disclosure will be described below.

Figure 12:
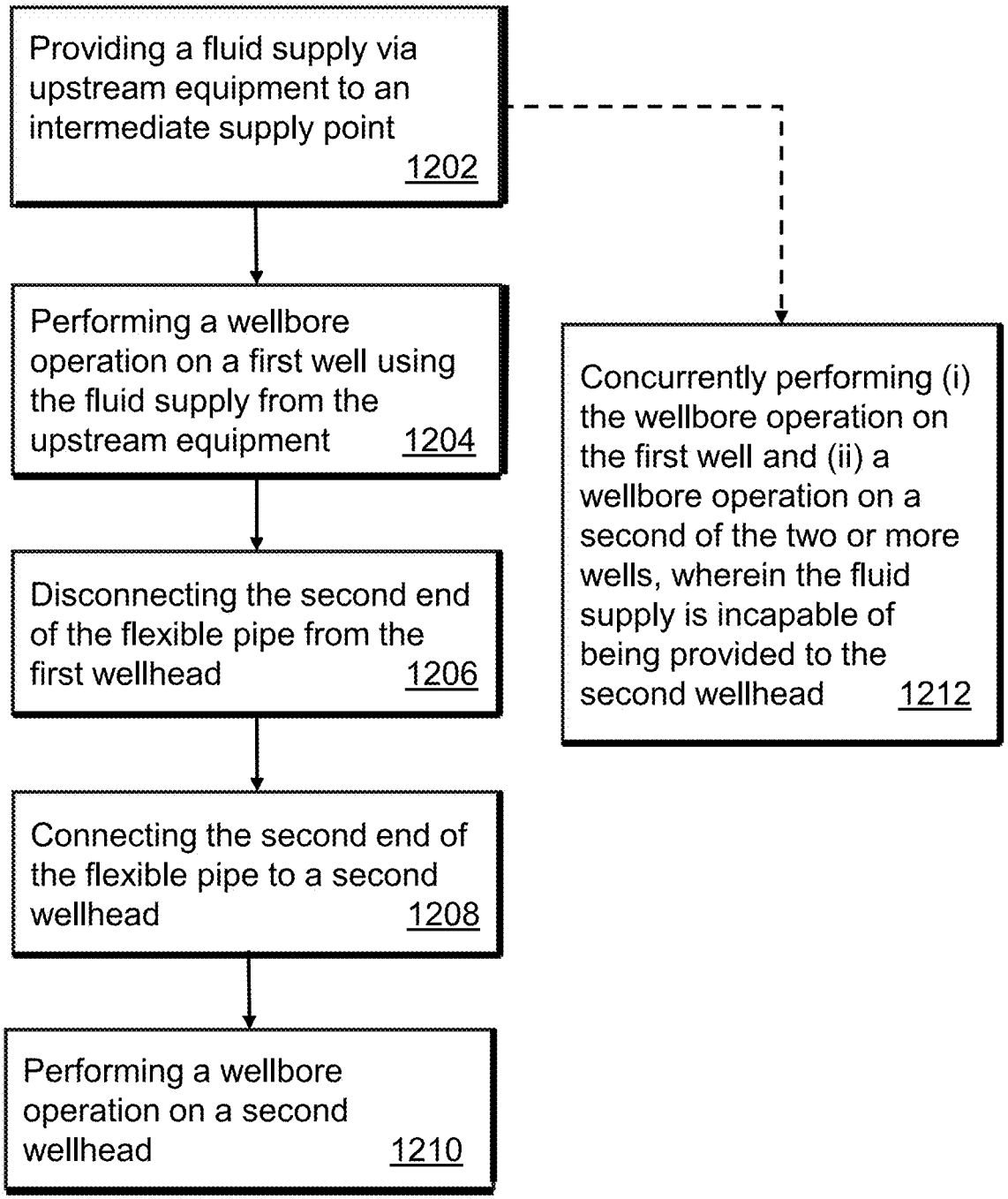

As shown in FIG. 12, in a first step 1202, a Christmas tree 204*a* connected to a first wellhead 215*a* may be connected to an isolation valve 202 via a connection system 200. Connecting the Christmas tree 204*a* to the isolation valve 202 may comprise connecting a first end 208 of a flexible connector line 206 to the isolation valve 202 and connecting a second end 210 of the flexible connector line 206 to the Christmas tree 204. Metal-to-metal seals may be formed between flexible connector line 206 and the isolation valve 202 and Christmas tree 204. One or more valves within the connection system 200 may be opened.

In a second step 1204, a wellbore operation may be performed on the first wellhead 215*a*. In some embodiments, the wellbore operation may be fracturing stimulation performed on a segment of the first wellbore. The wellbore operation may also be any wellbore operation known in the art.

In a third step 1206, the first Christmas tree 204*a* may be disconnected from the isolation valve 202. One or more valves within the connection system may be closed. The second end 210 of the flexible connection line 206 may be disconnected from the Christmas tree 204. This may break the metal-to-meta seal formed between the flexible connection line 206 and the Christmas tree 204. The first end 208 of the flexible connection line 206 may remain attached to the isolation valve 202 or other upstream equipment and the metal-to-metal seal formed between them may remain intact.

While the first step 1202, second step 1204, and third step 1206 are being performed, other operations using other equipment may be performed on the second wellhead 215*b*. In some embodiments, plugs may be removed from and/or installed in the second wellbore to seal an area of the wellbore for fracturing stimulation. The equipment may be disconnected from the second wellhead 215*b*/second Christmas tree 204*b* after completion of the operations.

In a fourth step, the second end 210 of the flexible connection line 206 may be moved from a position proximate the first Christmas tree 204*a* to a position proximate the second Christmas tree 204*b*. When used, the flexible connection line 206 may be disposed on a cart 214 at a point near the second end 210. The cart 214 may be disposed on a track 212. The cart 214 may be translated along the track 212, thereby moving the second end 210 from the position proximate the first Christmas tree 204*a* to the position proximate the second Christmas tree 204*b*. In some embodiments, the cart 214 and/or track 212 may include a mechanism by which the cart 214 automatically stops proximate the second Christmas tree 204*b*. In some embodiments, the cart 214 may be manually driven.

In a fifth step 1208, the second Christmas tree 204*b* connected to the second wellhead 215*b* may be connected to the isolation valve 202 or other upstream equipment via the connection system 200. The first end 208 of the flexible connector line 206 may already be connected to the isolation valve 202 and a metal-to-metal seal may be formed therebetween. The second end 210 of the flexible connector line 206 may now be connected to the second Christmas tree 204*b* and a seal may be formed therebetween. One or more valves within the connection system 200 may be opened.

In a sixth step 1210, a wellbore operation may be performed on the second wellhead. In some embodiments, the wellbore operation may be fracturing stimulation performed on a segment of the second wellbore. The wellbore operation may also be any wellbore operation known in the art.

In a seventh step 1212, the second Christmas tree 204*b* may be disconnected from the isolation valve 202. One or more valves within the connection system may be closed. The second end 210 of the flexible connection line 206 may be disconnected from the Christmas tree 204*b*. This may break the seal formed between the flexible connection line 206 and the Christmas tree 204*b*. The first end 208 of the flexible connection line 206 may remain attached to the isolation valve 202 and the seal formed therebetween may remain intact.

While the fifth, sixth, and seventh steps are being performed, other operations using other equipment may be performed on the first wellhead. In some embodiments, plugs may be removed from and/or installed in the first wellbore to seal an area of the wellbore for fracturing stimulation. The equipment may be disconnected from the first wellhead/first Christmas tree 204*a* after completion of the operations.

In an eighth step, the second end 210 of the flexible connection line 206 may be moved from a position proximate the second Christmas tree 204*b* to a position proximate the first Christmas tree 204*a*. When used, the flexible connection line 206 may be disposed on a cart 214 at a point near the second end 210. The cart 214 may be disposed on a track 212. The cart 214 may be translated along the track 212, thereby moving the second end 210 from the position proximate the second Christmas tree 204*b* to the position proximate the first Christmas tree 204*a*. In some embodiments, the cart 214 and/or track 212 may include a mechanism by which the cart 214 automatically stops proximate the first Christmas tree 204*a*. In some embodiments, the cart 214 may be manually driven.

Steps one through eight may be repeated any number of times. If the operation being performed is a fracturing operation, the steps may be repeated until an entire desired length of a horizontal wellbore is fractured. For example, the steps may be repeated about fifty to one hundred times to fracture the desired portions of a 2000 ft to 4000 ft length of a horizontal wellbore. At the conclusion of the method, the connection system 200 may be entirely disconnected from the Christmas trees 204*a*, 204*b*.

In some embodiments, the method may include pumping high pressure fluid from a pump truck to a pump manifold through a connection system including flexible piping. One skilled in the art will recognize that any of the embodiments of the system discussed above may be used to perform a method in accordance with the present disclosure.

As illustrated in FIG. 1, the pump manifold 72 is located proximate the numerous pump trucks. In other embodiments, the pump manifold may be located more remote from the pump trucks, such as at a location intermediate the location of the pump trucks and the wellheads. A flexible piping system may be provided for fluidly connecting each high pressure pump truck outlet to the remote pump manifold. The above-described monoline system may then be used to connect the remote pump manifold to a single wellhead for performance of the fracturing operation.

The methods and systems disclosed herein may have advantages over standard methods and systems for performing fracturing stimulation and/or simultaneous operations at onshore wellsites.

First, these methods and systems may allow simultaneous operations to be performed more safely because they do not require multiple wellbores to be fluidly connected to each other. This may allow operations requiring high pressures, such as fracture stimulation operations to be safely performed simultaneously. This may reduce the risk of damage to or failure of equipment and further reduce resulting damage to the surrounding environment or injury to personnel.

Second, these methods and systems may allow fracturing operations and other wellbore operations to be performed more quickly. Connections from each wellbore to the operation equipment may be able to be made and broken more quickly than using standard equipment and methods. This may reduce downtime for the fracturing equipment and related equipment used to install and remove plugs. In an exemplary case, standard systems and methods may allow four to five fracturing steps to be completed in a day. The present system in contrast may allow about six fracturing steps to be completed each day.

Third, these methods and systems may allow wellbore operations, especially fracturing operations, to be performed more inexpensively. The time savings described above lead directly to cost savings. In addition, the systems described herein require significantly less equipment than traditional fracturing systems. Therefore, these systems are significantly less expensive. In an exemplary case, a system disclosed herein for fracturing four wellbores may be about eight hundred thousand dollars less expensive than a traditional system for fracturing four wells.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A method for performing simultaneous operations at a wellsite comprising two or more adjacent wellheads, each respectively connected to a well, the method comprising:

providing a fluid supply via upstream equipment to an intermediate supply point;

fluidly connecting the intermediate supply point to a single wellhead, the fluidly connecting comprising connecting a first end of a flexible pipe to the intermediate supply point and a second end of the flexible pipe to a first wellhead;

performing a wellbore operation on a first well using the fluid supply from the upstream equipment supplied to the first wellhead;

disconnecting the second end of the flexible pipe from the first wellhead; and connecting the second end of the flexible pipe to a second wellhead.

2. The method of claim 1, wherein the flexible pipe is capable of retaining a fluid supply having a pressure in the range of 5000 psia to 15000 psia.

3. The method of claim 1, further comprising concurrently performing (i) the wellbore operation on the first well and (ii) a wellbore operation on a second of the two or more wells, wherein the fluid supply is incapable of being provided to the second wellhead.

4. The method of claim 3, wherein the wellbore operation on the first well comprises a fracturing operation and the fluid supply comprises a fracturing fluid.

5. The method of claim 4, wherein the wellbore operation on the second of the two or more wells comprises a wireline operation.

6. The method of claim 1, further comprising performing a wellbore operation on the second well using the fluid supply from the upstream equipment supplied to the second wellhead.

7. The method of claim 6, further comprising concurrently performing (iii) the wellbore operation on the second well and (iv) a wellbore operation on another of the two or more wells, wherein the fluid supply is incapable of being provided to the another of the two or more wells.

8. The method of claim 7, wherein the wellbore operation on the second well comprises a fracturing operation and the fluid supply comprises a fracturing fluid.

9. The method of claim 8, wherein the wellbore operation on the another of the two or more wells comprises a wireline operation.

10. The method of claim 1, further comprising, following the disconnecting the second end of the flexible pipe from the first wellhead and prior to connecting the second end of the flexible pipe to the second wellhead, moving the second end of the flexible pipe from a position proximate the first wellhead to a position proximate the second wellhead.

11. The method of claim 10, wherein the moving comprises:

connecting a crane to a connection point proximate the second end of the flexible pipe; and translating the second end from the position proximate the first wellhead to the position proximate the second wellhead via the crane.

12. The method of claim 11, further comprising lifting the second end of the flexible pipe and contacting the second end with a guide system configured to align the second end of the flexible pipe with a second wellhead connection point.

13. The method of claim 10, wherein the moving comprises:

withdrawing the second end of the flexible pipe from a cradle proximate a first wellhead connection point; and disposing the second end of the flexible pipe in a cradle proximate a second wellhead connection point;

wherein each cradle comprises a guide for alignment of the second end of the flexible pipe with the respective wellhead connection point.

14. The method of claim 10, further comprising disposing a portion of the flexible pipe on a movable cart.

15. The method of claim 14, wherein the moving comprises moving the movable cart from a position proximate the first wellhead to a position proximate the second wellhead.

16. The method of claim 1, wherein the upstream equipment comprises pump trucks, the method further comprising increasing a pressure of a fracturing fluid to a pressure in the range of 5000 psia to 15000 psia and providing a flow of the fracturing fluid to the intermediate supply point.

17. A method for performing simultaneous operations at a wellsite comprising two or more adjacent wellheads, each respectively connected to a well, the method comprising:

providing a fluid supply via upstream equipment;

connecting a first end of a flexible pipe to the upstream equipment;

positioning a portion of the flexible pipe on a movable structure with a predefined pathway;

moving the movable structure along the predefined pathway to align a second end of the flexible pipe with and sealingly secure to an end of a first fluid conduit in fluid communication with only a first wellhead, thereby establishing fluid communication between the fluid supply and only the first wellhead;

disconnecting the second end from the end of the first fluid conduit; and moving the movable structure along the predefined pathway to align the second end of the flexible pipe with and sealingly secure to an end of a second fluid conduit in fluid communication with only a second wellhead, thereby establishing fluid communication between the fluid supply and only the second wellhead.

18. The method of claim 17, wherein the flexible pipe is capable of retaining a fluid supply having a pressure in the range of 5000 psia to 15000 psia.

19. The method of claim 17, wherein the first fluid conduit in fluid communication with only the first wellhead comprises a first flexible pipe coupled to the wellhead at a first end and a first valve at a second end, and the second end of the flexible pipe is sealingly secured to the valve.

20. The method of claim 19, further comprising the step of connecting the first end of the first flexible pipe to the first wellhead.

21. The method of claim 20, wherein connecting the first end of the first flexible pipe to the first wellhead comprising lifting the first end of the flexible pipe and contacting the first end with a guide system configured to align the first end of the flexible pipe with a wellhead connection point.

* * * * *